US005318738A

United States Patent [19]

Agarwal et al.

[11] Patent Number: 5,318,738

[45] Date of Patent: Jun. 7, 1994

[54] PROCESS OF MAKING HOLLOW POLYAMIDE FILAMENTS

[75] Inventors: Nirmal K. Agarwal; Raymond Longhi; Sundar M. Rao, all of Seaford, Del.

[73] Assignee: E. I. Du Pont de Nemours and Company, Wilmington, Del.

[21] Appl. No.: 45,295

[22] Filed: Apr. 13, 1993

[51] Int. Cl.[5] ..... D01D 5/253; D01F 1/08

[52] U.S. Cl. ..... 264/177.14; 264/211

[58] Field of Search ..... 264/177.14, 211, 211.12, 264/209.1

[56] References Cited

U.S. PATENT DOCUMENTS 3,216,186 11/1965 Opfell ..... 428/92
3,900,676 8/1975 Alderson ..... 428/372
4,218,509 9/1980 Edgar et al. ..... 528/339

FOREIGN PATENT DOCUMENTS 154784 4/1982 German Democratic Rep. .
158334 1/1983 German Democratic Rep. .

OTHER PUBLICATIONS

Translation of German Democratic Rep. 154, 784 (Published Apr. 12, 1982).
Translation of German Democratic Rep. 158, 334 (Published Jan. 12, 1983).

*Primary Examiner*—Leo B. Tentoni

[57] ABSTRACT

An improved process for preparing polyamide hollow filaments wherein an N,N'-dialkyl polycarbonamide is melt blended with the molten fiber-forming polyamide prior to spinning into filaments. The polycarbonamide substantially decreases the collapsing of the voids which naturally occurs immediately after spinning and before the filaments are completely cool.

3 Claims, 3 Drawing Sheets

PROCESS OF MAKING HOLLOW POLYAMIDE FILAMENTS

FIELD OF THE INVENTION

This invention relates to an improved process for manufacturing polyamide hollow filaments wherein an N,N'-dialkyl polycarbonamide is melt blended with the molten fiber-forming polyamide prior to spinning into filaments.

BACKGROUND OF THE INVENTION

Hollow filament nylon yarns which have one or more continuous axially extending voids running through the filaments are known in the art. The shape of the filament cross-section, number and location of voids, size and shape of voids all affect the filaments' bulk, soil hiding ability and luster.

The size (cross-sectional area) of the voids decreases considerably during the spinning process from the time that the filaments emerge from the spinneret until they are fully quenched. The size of the decrease may be minimized by increasing the melt viscosity of the polyamide or by cooling the filaments more rapidly as they emerge from the spinneret. East German Economic Patent 583 34 discloses the use of 0.02 to 3% of a neutral tenside additive (e.g. ethoxylated or oxypropylated alcohols, fatty acid esters and long-chain fatty amines) which when added to the molten polyamide prior to spinning minimizes the decrease in void size.

The use of very high viscosity polyamides can lead to spinning problems due to the propensity of such polyamides to cross-link. Molten filaments are generally cooled by blowing a cool gas over them as they emerge from the spinneret. Increasing the flowrate of cool gas so as to cool the filaments more rapidly causes the filaments to become unstable in the quench chimney which in turn causes processing problems. Introducing additives such as ethoxylated or oxypropylated compounds which are incompatible with the fiber-forming polyamide may adversely affect the luster, strength and processability of the filaments.

SUMMARY OF THE INVENTION

The present invention provides an improved method for preparing polyamide filaments having at least one continuous axially extending void. The process involves adding a liquid N,N'- dialkyl polycarbonamide to a molten fiber-forming polyamide, mixing well and then extruding the blend through a spinneret into filaments. This process minimizes the decrease in the percent void which occurs from the time that the filaments emerge from the spinneret until they are completely quenched. The polycarbonamide, while substantially immiscible with the fiber-forming polyamide (except when molten), is compatible with it. Furthermore, the polycarbonamide additive's index of refraction is not sufficiently different from that of the fiber-forming polyamide to affect the filament's luster.

The resulting hollow filaments are comprised of from about 0.1 to about 10 weight percent N,N'-dialkyl polycarbonamide and from about 90 to 99.9 weight percent fiber-forming polyamide. The percent void of filaments of this invention is from about 5 to about 25%.

DETAILED DESCRIPTION OF THE INVENTION

Figure 1:
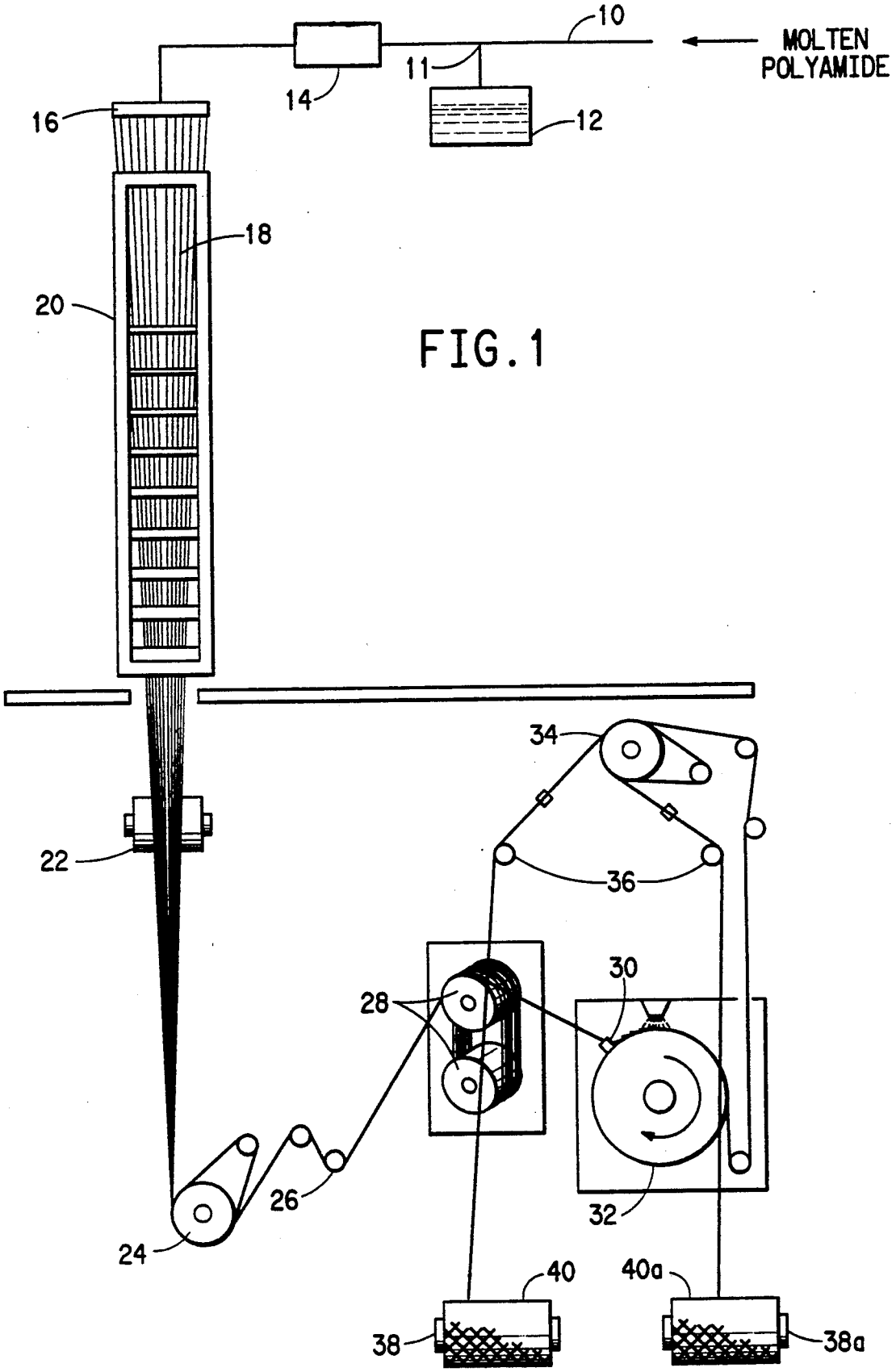
FIG. 1 is a schematic depiction of a preferred embodiment of this invention.

Referring to FIG. 1, molten fiber-forming polyamide is pumped from its source, which may be an extruder or a continuous polymerizer, through a transfer line 10 ultimately to spinneret 16. In a preferred embodiment, at location 11 between the spinneret and the source of fiber-forming polymer, a liquid N,N'-dialkyl polycarbonamide is pumped from a supply 12 and injected into the transfer line. Depending on the melting point of the polycarbonamide, supply 12 may need to be heated in order to liquefy the polycarbonamide. The ability of the N,N'-dialkyl polycarbonamide to minimize the decrease in the percent void content of the filaments of this invention (before they are completely quenched) is dependent on the residence time of the polycarbonamide in the molten fiber-forming polyamide. Residence time should be minimized in order to maximize the effect of the additive on the percent void content of the filaments. The only other limitation on where in the process the polycarbonamide is injected is that adequate mixing of it and the fiber-forming polyamide must take place prior to the spinneret. Alternatively, the polycarbonamide may be added to a screw melter (not shown) and mixed there with fiber-forming polymer before it is pumped through the transfer line to the spinneret. The polycarbonamide may be added neat or in combination with other additives including other polymers. Immediately after the polycarbonamide is added to fiber-forming polymer in the process, is a mixer 14 which may be a dynamic mixer, a static mixer or a combination of dynamic and static mixers. The remaining steps in the process for making hollow filaments are standard spinning and drawing procedures. The mixture or blend is spun through spinneret 16 which is designed so as to produce hollow filaments and into a quench chimney 20 where a cooling air is blown past the hot filaments 18. The filaments are then pulled from the spinneret 16 and through the quench zone by means of a puller or feed roll 24. After quenching in air, the filaments are treated with spin-draw finish material by contacting a finish applicator 22. Next, the filaments pass around feed roll 24 from where the yarn is drawn over a pair of draw pins 26 by a pair of heated draw rolls 28. An insulated enclosure reduces loss of heat energy from draw rolls 28. The resulting yarn may be crimped and cut into staple or bulked to make BCF. For BCF, the yarn filaments are heated and advanced for bulking by a hot air jet 30 of the type described in Breen and Lauterbach, U.S. Pat. No. 3,186,155. The hot fluid exhausts with the threadlines against a rotating drum 32 having a perforated surface, on which the yarns are cooled to set the crimp using air and, optionally, a mist quench of deionized water. From the drum 32, the threadlines in bulky form pass to a driven take-up roll 34, over secondary finish applicators 36 onto rotating cores 38 and 38a to form packages 40 and 40a. The N,N'-dialkyl polycarbonamides of this invention melt below 100° C., making it unnecessary to use a screw melter to liquefy the polycarbonamide. Preferably the polycarbonamide is liquid at room temperature, melting at less than about 30° C. Its molecular weight is in the range of 800–5000. Typically these polycarbonamides are made from an aliphatic diamine having alkyl substitution at both nitrogen atoms and from an aliphatic dicarboxylic acid. The diamine may contain minor amounts of single substituted or unsubstituted nitrogens. Preferably the alkyl substitution groups of the diamine contain between 2–12 carbon atoms. Between 2–6 carbons are especially preferred. The diamine preferably has between 2–12 carbon atoms in its alkylene group. The dicarboxylic acid group. The additive polymer may be end capped with, for example, stearic acid. These polymers and methods for making them are disclosed in U.S. Pat. No. 3,900,676, the disclosure of which is hereby incorporated by reference. Some suitable N,N'-dialkyl polycarbonamides include those prepared using N,N'-diethylhexamethylene diamine, N,N'-dibutylhexamethylene diamine and adipic, azelaic or dodecanedioic acid. Preferably the polycarbonamide is poly(N,N'-diethylhexamethylene dodecanediamide) or poly(N,N'-dibutylhexamethylene dodecanediamide). Poly(N,N'-dibutylhexamethylene dodecanediamide) is especially preferred. The latter is a liquid at room temperature (25° C.) and has a number average molecular weight of approximately 2400. The polymer is end capped with approximately 15 weight percent stearic acid.

The hollow filament polyamides of this invention can be prepared by combining from about 0.1 to about 10 weight percent N,N'-dialkyl polycarbonamide and from about 90 to 99.9 weight percent fiber-forming polyamide. Below 0.1% polycarbonamide additive, the affect on void size is minimal. Much above 10% polycarbonamide additive can adversely affect the physical properties and spinning performance of the fiber. The fiber-forming polyamide may be any polyamide such as nylon 6 or nylon 66 or copolymers thereof. The filament cross-section may be any shape including, but not limited to circular, square, trilobal, or delta. The shape of the voids may be anything including circular, square, diamond, triangular, "v"-shaped, etc. The total cross-sectional area of the void(s) in a hollow filament of this invention, as a percent of the total cross-sectional area of the filament (% void), is between about 5 to about 25%.

TEST METHODS

Relative Viscosity (RV) is the formic acid relative viscosity measured as described at col. 2, lines 42–51, in Jennings, U.S. Pat. No. 4,702,875, the disclosure of which is hereby incorporated by reference.

Amine and Carboxyl Ends are determined by the methods described on pages 293 and 294 in Volume 17 of the "Encyclopedia of Industrial Chemical Analysis" published by John Wiley & Sons (1973).

Percent void of the filaments is calculated by casting a number of filaments in an epoxy resin, microtoming perpendicular to the longitudinal axes of the filaments so as to form 8 to 10 micron thick cross-sections, mounting the cross-sections between two microscope slides, viewing the cross-sections under magnification and calculating the cross-sectional areas of the filaments and the voids. The percent void is the cross-sectional area of the voids divided by the cross-sectional area of the filaments and multiplied by 100%.

EXAMPLES

The following examples are offered for the purposes of illustrating the invention and are not intended to be limiting. Percentages are by weight except where otherwise indicated. The fiber-forming polyamide used in the controls and in the examples is the copolyamide described in U.S. Pat. No. 5,108,684, the disclosure of which is hereby incorporated by reference.

CONTROL 1

A nylon 66 copolymer containing 3% by weight of sodium 5-sulfoisophthalic acid, randomly distributed through the polymer chain, was prepared in an autoclave by a conventional batch condensation polymerization technique with salts of hexamethylene diamine and adipic acid, and hexamethylene diamine and sodium 5-sulfoisophthalic acid. The polymer was pelletized into flake after the polymerization, and this flake was then further polymerized in a solid phase polymerizer with the use of inert gas under controlled temperature and humidity conditions. Nominal formic acid RV=28, amine ends=62 eq./1,000 kg and carboxyl ends=68 eq./1,000 kg.

Figure 2:
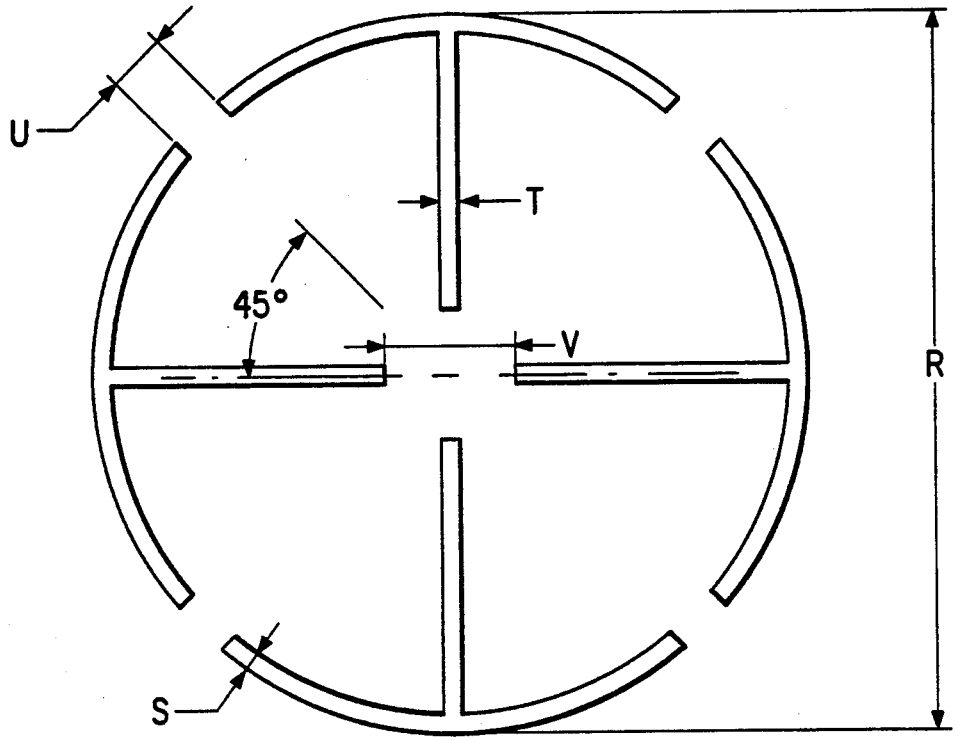
FIG. 2 is a plan view of the slots in one hole of a spinneret suitable for making hollow filaments of this invention.
Figure 3:
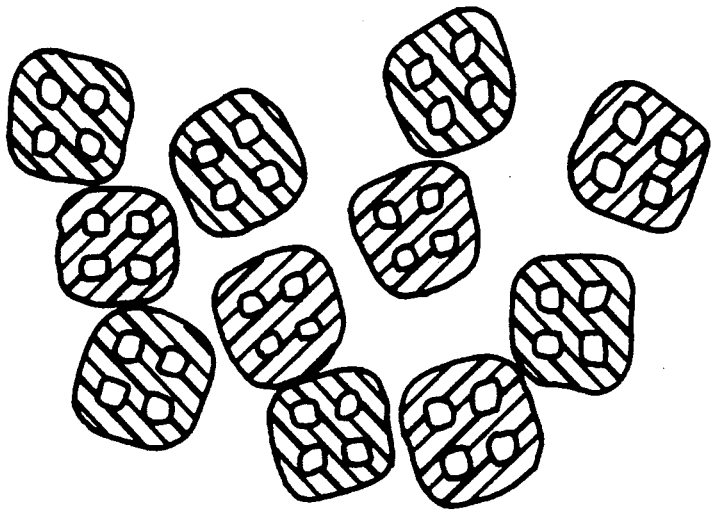
FIG. 3 is an enlarged cross-sectional view taken from a photomicrograph of a hollow filament polyamide of this invention made from the spinneret shown in FIG. 2.

The flake was fed to a twin-screw melter and spun at a rate of 74 pounds/hour (33.6 kg/hour) through a 128 hole hollow filament spinneret of the geometry shown in FIG. 2. Referring to FIG. 2, the following dimensions were used, R=0.080 in. (0.203 cm), S=0.0031 in. (0.0079 cm), T=0.0024 in. (0.0061 cm), U=0.0080 in. (0.020 cm) and V=0.015 in. (0.038 cm). The capillary depth was 0.004 in. (0.010 cm). The RV of the polymer at the spinneret was a nominal 57. Cooling air (about 10° C.) was blown past the hot filaments at a flow rate of about 250 cubic ft./minute (7.1 cubic meters/minute). The 64 filaments in each of the two yarn bundles were pulled from the spinneret and through the quench zone by means of a puller or feed roll, rotating at 923 yards per minute (843 meters/minute). After quenching, the filaments were treated with spin-draw finish. Next, the filaments were drawn over a pair of draw pins by a pair of heated (200° C.) draw rolls, rotating at 2538 ypm (2320 meters/minute). The yarn filaments were heated and bulked as described in Breen and Lauterbach, U.S. Pat. No. 3,186,155. The bulking air temperature was 220° C. The final product was a 1245 denier (1360 dtex), 18 denier (19.7 dtex) per filament yarn. The cross-section of the filaments is shown in FIG. 3. The % void was measured as described in the above test method and is shown in the Table.

CONTROL 2

Figure 4:
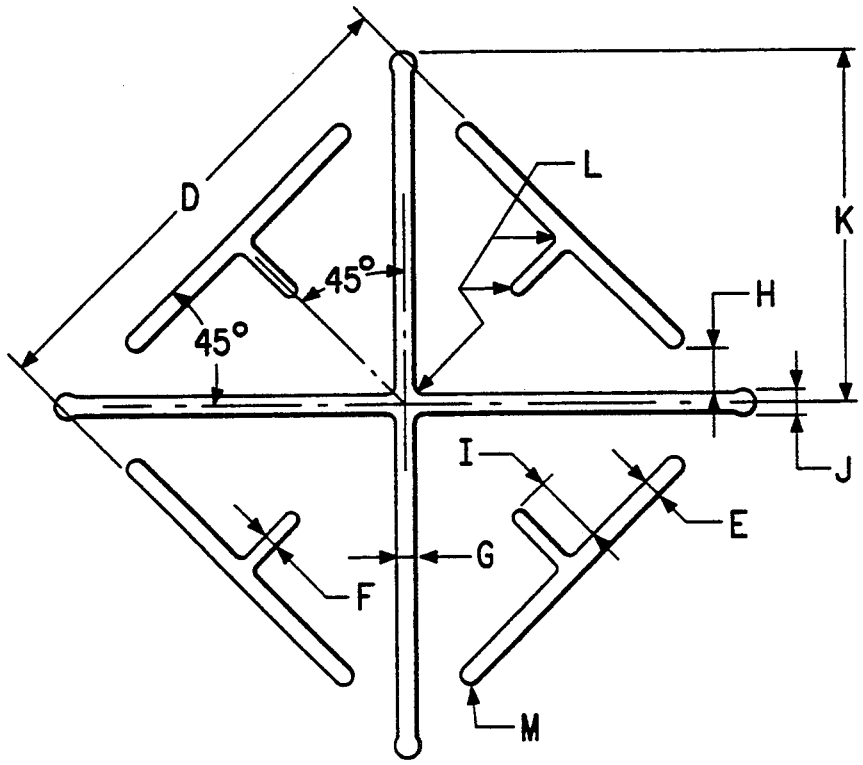
FIG. 4 is a plan view of the slots in one hole of a second spinneret used to make filaments of this invention.

The nylon polymer, spinning equipment and spinning conditions were the same as in Control 1 above, except that the spinneret was changed to that shown in FIG. 4, and the cooling air flow rate was 300 cubic feet/minute (8.5 cubic meters/minute). Referring to FIG. 4, the following dimensions were used D=0.100 in. (0.254 cm), E=0.0038 in. (0.0097 cm), F=0.0029 in. (0.0074 cm), G=0.0032 in. (0.0081 cm), H=0.0050 in. (0.0127 cm), I=0.0110 in. (0.0279 cm), J=0.0032 in. (0.0081 cm), K=0.0690 in. (0.175 cm), radii L=0.0010 in.

Figure 5:
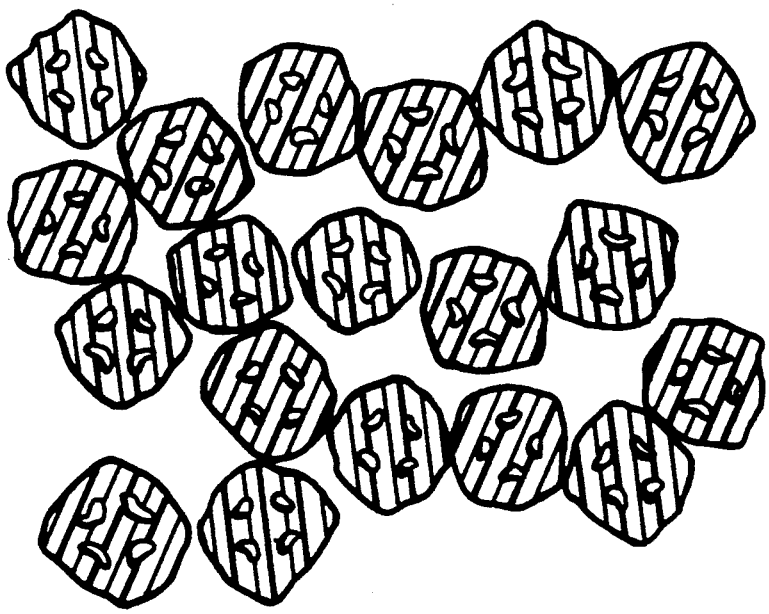
FIG. 5 is an enlarged cross-sectional view taken from a photomicrograph of a hollow filament polyamide of this invention made from the spinneret shown in FIG. 4.

(0.0025 cm), radius M=0.0019 in. (0.0048 cm). The capillary depth was 0.0180 in. (0.0457 cm). The filaments produced had the cross-section shown in FIG. 5.

The % void was measured as described in the above test method and is shown in the Table.

EXAMPLES 1 AND 2

The nylon copolymer, spinning equipment and spinning conditions were the same as in Control 1 above, except poly(N,N'-dibutylhexamethylene dodecanediamide) additive was injected into the nylon 66 copolymer melt just before the spinneret and mixed with the molten nylon 66 copolymer via a series of in-line Koch and Kenics static mixers.

The % void was measured and is shown in the Table. With only 0.47% additive, the % void was 37% larger than that of the control. At 0.94% additive the resulting voids were 51% larger than those of the control.

EXAMPLES 3 AND 4

All spinning equipment and the process conditions were the same as Control 2. The injection of poly(N,N'-dibutylhexamethylene dodecanediamide) additive was the same as in Example 1.

The % void values of the filaments produced are contained in the Table. The % void of filaments containing the additive were significantly larger (43% larger in the case of 1.41% additive and 68% larger in the case of 2.84% additive) than that of the control.

TABLE

| | % ADDITIVE | % VOID | % INCREASE IN % VOID VS. CONTROL |
|---|---|---|---|
| Control 1 | 0 | 15.6 | 0 |
| Example 1 | 0.47 | 21.4 | 37 |
| Example 2 | 0.94 | 23.6 | 51 |
| Control 2 | 0 | 12.0 | 0 |
| Example 3 | 1.41 | 17.2 | 43 |
| Example 4 | 2.84 | 20.1 | 68 |

We claim:

1. A method for producing polyamide filaments having at least one continuous axially extending void comprising the steps of:

a) adding to a molten fiber-forming polyamide from about 0.1 to about 10 weight percent of an N,N'-dialkyl polycarbonamide having a melting point less than about 100° C. and a molecular weight between about 800–5000;

b) mixing said polycarbonamide with said molten fiber-forming polyamide to produce a uniform blend; and c) extruding said blend through a spinneret to form filaments having at least one continuous axially extending void, whereby a decrease in percent void of the filaments after emerging from the spinneret is minimized.

2. The method of claim 1 wherein said N,N'-dialkyl polycarbonamide is selected from the group consisting of poly(N,N'-diethylhexamethylene dodecanediamide) and poly(N,N'-dibutylhexamethylene dodecanediamide).

3. The method of claim 2 wherein the N,N'-dialkyl polycarbonamide is poly(N,N'-dibutylhexamethylene dodecanediamide).

* * * * *